US007632781B2

(12) United States Patent
Kurose et al.

(10) Patent No.: US 7,632,781 B2
(45) Date of Patent: Dec. 15, 2009

(54) COLOR DEVELOPER FOR HEAT SENSITIVE RECORDING, PROCESS FOR PRODUCING THE COLOR DEVELOPMENT AND HEAT SENSITIVE RECORDING MATERIAL

(75) Inventors: Mikihiko Kurose, Yoshida-gun (JP); Takeo Hasegawa, Sakai (JP)

(73) Assignee: Nicca Chemical Co., Ltd., Fukui-shi, Fukui (JP)

( * ) Notice: Subject to any disclaimer, the term of this patent is extended or adjusted under 35 U.S.C. 154(b) by 431 days.

(21) Appl. No.: 11/547,182

(22) PCT Filed: Apr. 18, 2005

(86) PCT No.: PCT/JP2005/007752

§ 371 (c)(1),
(2), (4) Date: Sep. 29, 2006

(87) PCT Pub. No.: WO2005/102726

PCT Pub. Date: Nov. 3, 2005

(65) Prior Publication Data

US 2007/0219094 A1 Sep. 20, 2007

(30) Foreign Application Priority Data

Apr. 21, 2004 (JP) ..... 2004-125395

(51) Int. Cl.
*B41M 5/333* (2006.01)

(52) U.S. Cl. ..... 503/216; 106/31.17; 427/150

(58) Field of Classification Search ..... None
See application file for complete search history.

(56) References Cited

U.S. PATENT DOCUMENTS

| | | | |
|---|---|---|---|
| 4,636,819 | A | 1/1987 | Nagamoto et al. |
| 5,284,978 | A | 2/1994 | Kinishi et al. |

FOREIGN PATENT DOCUMENTS

| | | | |
|---|---|---|---|
| JP | 04-210955 | A | 8/1992 |
| JP | 2001-261633 | A | 9/2001 |
| JP | 2001-310561 | A | 11/2001 |
| JP | 2002-030064 | A | 1/2002 |
| JP | 2004-209727 | A | 7/2004 |

OTHER PUBLICATIONS

Office Action (Notice of Reason(s) of Rejection) dated Jul. 3, 2009 issued by the Japanese Patent Office for Japanese patent application.

*Primary Examiner*—Bruce H Hess
(74) *Attorney, Agent, or Firm*—Frishauf, Holtz, Goodman & Chick, P.C.

(57) ABSTRACT

A color developer for heat sensitive recording which comprises 0.5 to 5 parts by mass of 3-allyl-4-allyloxy-4'-hydroxydiphenylsulfone, 4-allyloxy-3'-allyl-4'-hydroxydiphenylsulfone or a mixture of these compounds per 100 parts by mass of 4-allyloxy-4'-hydroxydiphenylsulfone, a process for producing the color developer and a heat sensitive recording material comprising the color developer in the heat sensitive color forming layer. The color developer and the recording material suppress fog on the background and exhibit excellent color forming property and storage property of image portions.

14 Claims, No Drawings

COLOR DEVELOPER FOR HEAT SENSITIVE RECORDING, PROCESS FOR PRODUCING THE COLOR DEVELOPMENT AND HEAT SENSITIVE RECORDING MATERIAL

This application is the United States national phase application of International Application PCT/JP2005/007752 filed Apr. 18, 2005.

TECHNICAL FIELD

The present invention relates to a color developer for heat sensitive recording and a heat sensitive recording material. More particularly, the present invention relates to a color developer for heat sensitive recording and a heat sensitive recording material which suppress fog on the background and exhibit excellent color forming property and storage property of image portions.

BACKGROUND ART

Heat sensitive recording materials having a heat sensitive color forming layer which forms color by heating and is formed on a support such as paper, synthetic paper and a plastic film are utilized for thermal printers for various portable terminals, printers of medical images attached to supersonic echo image processing instruments, thermopen recorders for electrocardiograms and analytical instruments, airplane tickets, train tickets and POS labels for merchandises.

The heat sensitive recording materials are produced, in general, as follows: a colorless or slightly colored leuco dye as the color forming substance and a color developer which develops color by reaction with the color forming substance to record data are finely pulverized and dispersed in a solvent; sensitizing substances for enhancing the effects of the color forming substance and the color developer, waxes, surfactants, defoaming agents and inorganic pigments are added, where necessary; binders such as resins soluble in water are added; and the resultant mixture is applied to a support such as paper to form a coating layer and dried to form a color forming layer. As the color developer which develops color by reaction with the color forming substance, various phenol compounds are widely used.

For applications requiring a great sensitivity to heat, a sensitizing substance which lowers the temperature of the color formation and enhances the effects of the color forming substance and the color developer is added. As the sensitizing substance, for example, paraffin wax, fatty acid amides and aromatic esters are used. Various properties, such as the excellent whiteness without fog on the background, an excellent color forming property to form color with a small energy and an excellent property for storage of the obtained images, are required for the heat sensitive recording material. In particular, the color developing substance is an important factor for the requirements for the heat sensitive recording material. Even when the color forming substance and the sensitizer exhibit excellent properties, occasionally, no excellent recording materials can be obtained due to a color developer exhibiting poor properties.

The present invention has an object of providing a color developer for heat sensitive recording and a heat sensitive recording material which suppress fog on the background and exhibit excellent color forming property and storage property of image portions.

DISCLOSURE OF THE INVENTION

As the result of intensive studies by the present inventors to achieve the above object, it was found that a heat sensitive recording material which suppresses fog on the background and exhibits excellent color forming property and storage property of image portions could be obtained by using 4-allyloxy-4'-hydroxydiphenylsulfone and a small amount of a 4-alkenyloxy-4'-hydroxydiphenylsulfone having a specific substituent at the aromatic ring as the color developer. The present invention has been completed based on the knowledge.

The present invention provides:

(1) A color developer for heat sensitive recording which comprises 0.5 to 5 parts by mass of at least one compound selected from a group consisting of 3-allyl-4-allyloxy-4'-hydroxydiphenylsulfone and 4-allyloxy-3'-allyl-4'-hydroxydiphenylsulfone per 100 parts by mass of 4-allyloxy-4'-hydroxydiphenylsulfone;

(2) A heat sensitive recording material which comprises a color developer for heat sensitive recording described (1) in a heat sensitive color forming layer;

(3) The heat sensitive recording material described in (2), which comprises a colorless or slightly colored leuco dye as a color forming substance in the heat sensitive color forming layer;

(4) The heat sensitive recording material described in (3), wherein the leuco dye is a dye having a fluoran structure;

(5) The heat sensitive recording material described in any one of (2) to (4), which comprises a sensitizer in the heat sensitive color forming layer;

(6) The heat sensitive recording material according to any one of (2) to (5), wherein the heat sensitive color forming layer further comprises an image stabilizing substance; and (7) A process for producing a color developer for heat sensitive recording described in (1) which comprises bringing 1.03 to 1.18 moles of an allyl halide into reaction with 1 mole of 4,4'-dihydroxyldiphenylsulfone in a presence of an alkali and recrystallizing an obtained reaction product using a mixed solvent of water and an alcohol.

THE MOST PREFERRED EMBODIMENT TO CARRY OUT THE INVENTION

The developer for heat sensitive recording of the present invention comprises 0.5 to 5 parts by mass and preferably 0.7 to 4 parts by mass of 3-allyl-4-allyloxy-4'-hydroxydiphenylsulfone, 4-allyloxy-3'-allyl-4'-hydroxydiphenylsulfone or a mixture of these compounds per 100 parts by mass of 4-allyloxy-4'-hydroxydiphenylsulfone.

In the present invention, when the content of 3-allyl-4-allyloxy-4'-hydroxydiphenylsulfone, 4-allyloxy-3'-allyl-4'-hydroxydiphenylsulfone or a mixture of these compounds per 100 parts by mass of 4-allyloxy-4'-hydroxydiphenylsulfone is smaller than 0.5 parts by mass, the color forming property of the heat sensitive recording material decreases. A great amount of heat is required for the color formation, and the speed of printing decreases. Moreover, there is the possibility that the storage stability of image portions decreases, and the color density of images decreases under the environment of high temperatures and the environment of heat and moisture. When the content of 3-allyl-4-allyloxy-4'-hydroxydiphenylsulfone, 4-allyloxy-3'-allyl-4'-hydroxydiphenylsulfone or a mixture of these compounds per 100 parts by mass of 4-allyloxy-4'-hydroxydiphenylsulfone exceeds 5 parts by mass, fog tends to be formed on the background, and there is the possibility that obtaining a heat sensitive recording material exhibiting excellent whiteness becomes difficult. By adjusting the content of 3-allyl-4-allyloxy-4'-hydroxydiphenylsulfone, 4-allyloxy-3'-allyl-4'-hydroxy-diphenylsulfone or a mixture of these compounds in the range of 0.5 to 5 parts by mass per 100 parts by mass of 4-allyloxy-4'-hydroxydiphenylsulfone, a useful color developer suppressing fog on the background and exhibiting excellent color forming property and stability of images can be obtained.

The process for producing 3-allyl-4-allyloxy-4'-hydroxydiphenylsulfone, 4-allyloxy-3'-allyl-4'-hydroxydiphenylsulfone or a mixture of these compounds is not particularly limited. For example, a mixture comprising 0.5 to 5 parts by mass of 3-allyl-4-allyloxy-4'-hydroxydiphenylsulfone, 4-allyloxy-3'-allyl-4'-hydroxy-diphenylsulfone or a mixture of these compounds per 100 parts by mass of 4-allyloxy-4'-hydroxydiphenylsulfone can be produced by suitably selecting the conditions of the reaction and the purification in a series of stages in the production of 4-allyloxy-4'-hydroxydiphenylsulfone using 4,4'-dihydroxydiphenylsulfone and an allyl halide as the raw materials.

Specifically, a mixture comprising 0.5 to 5 parts by mass of 3-allyl-4-allyloxy-4'-hydroxydiphenylsulfone, 4-allyloxy-3'-allyl-4'-hydroxydiphenylsulfone or a mixture of these compounds per 100 parts by mass of 4-allyloxy-4'-hydroxydiphenylsulfone can be produced by bringing 1.03 to 1.18 moles and preferably 1.05 to 1.15 moles of an allyl halide into reaction with 1 mole of 4,4'-dihydroxyldiphenylsulfone in the presence of an alkali such as sodium hydroxide and recrystallizing the obtained reaction product using a mixed solvent of water and an alcohol.

When allyl group is introduced into 4,4'-dihydroxydiphenylsulfone by heating a mixture obtained by adding 4,4'-dihydroxydiphenylsulfone and an alkali such as sodium hydroxide to water to obtain a homogeneous solution, followed by adding an allyl halide dropwise, the amount of allyl group introduced into the aromatic ring is decreased by decreasing the amount of the allyl halide, lowering the temperature of the reaction and decreasing the rate of dropwise addition, and the amount of allyl group introduced into the aromatic ring is increased by increasing the amount of the allyl halide, elevating the temperature of the reaction and increasing the rate of dropwise addition. The formed amount of 3-allyl-4-allyloxy-4'-hydroxydiphenylsulfone, and/or 4-allyloxy-3'-allyl-4'-hydroxydiphenylsulfone can be controlled by suitably selecting the conditions of the reaction such as the type and the amount of the solvent, the temperature of the reaction and the time of the reaction.

Since the reaction product of 4,4'-dihydroxydiphenylsulfone and the allyl halide contains impurities and is colored, the reaction product is purified by recrystallization. Examples of the alcohol in the mixed solvent of water and an alcohol used for the recrystallization include ethanol, 1-propanol and 2-propanol. By using the mixed solvent of water and an alcohol for the recrystallization, the reaction product can be purified as the mixture without removing 3-allyl-4-allyloxy-4'-hydroxydiphenylsulfone and/or 4-allyloxy-3'-allyl-4'-hydroxydiphenylsulfone formed by the reaction of 4,4'-dihydroxydiphenylsulfone and the allyl halide. When the recrystallization is conducted using an organic solvent, 4-allyloxy-4'-hydroxydiphenylsulfone having a great purity can be obtained, and 3-allyl-4-allyloxy-4'-hydroxydiphenylsulfone and 4-allyloxy-3'-allyl-4'-hydroxydiphenylsulfone are dissolved into the solvent and lost.

In the present invention, 3-allyl-4-allyloxy-4'-hydroxydiphenylsulfone and/or 4-allyloxy-3'-allyl-4'-hydroxydiphenylsulfone may be produced, and the required amount of the product may be added to 4-allyloxy-4'-hydroxydiphenylsulfone to obtain the developer for heat sensitive recording. 3-Allyl-4-allyloxy-4'-hydroxydiphenylsulfone and/or 4-allyloxy-3'-allyl-4'-hydroxydiphenylsulfone can be obtained by the reaction of an alkenyl halide with an alkali metal salt of 3-allyl-4,4'-dihydroxydiphenylsulfone which is obtained in accordance with the Claisen rearrangement of 4-allyloxy-4'-hydroxydiphenylsulfone. 3-Allyl-4-allyloxy-4'-hydroxydiphenylsulfone and/or 4-allyloxy-3'-allyl-4'-hydroxydiphenylsulfone can also be produced in accordance with the Fiedel-Crafts reaction of 4-allyloxy-4'-hydroxydiphenylsulfone and an alkyl halide or an alkenyl halide.

3-Allyl-4-allyloxy-4'-hydroxydiphenylsulfone and 4-allyloxy-3'-allyl-4'-hydroxydiphenylsulfone exhibit excellent compatibility with 4-allyloxy-4'-hydroxydiphenylsulfone, and 3-allyl-4-allyloxy-4'-hydroxydiphenylsulfone and/or 4-allyloxy-3'-allyl-4'-hydroxydiphenylsulfone in an amount of 5 parts by mass or less per 100 parts by mass of 4-allyloxy-4'-hydroxydiphenylsulfone forms a uniform solid solution in the heat sensitive color forming layer. Therefore, the excellent color forming property can be exhibited.

The heat sensitive recording material of the present invention comprises a color developer for heat sensitive recording which comprises 0.5 to 5 parts by mass of at least one compound selected from the group consisting of 3-allyl-4-allyloxy-4'-hydroxydiphenylsulfone and 4-allyloxy-3'-allyl-4'-hydroxydiphenylsulfone per 100 parts by mass of 4-allyloxy-4'-hydroxydiphenylsulfone in the heat sensitive color forming layer.

It is preferable that the heat sensitive recording material of the present invention comprises a colorless or slightly colored leuco dye as the color forming substance in the heat sensitive color forming layer. The colorless or slightly colored leuco dye used in the present invention is not particularly limited. Examples of the leuco dye include fluoran derivatives, quinazoline derivatives, phthalide derivatives, triphenylmethane derivatives and phenothiazine derivatives. The leuco dye may be used singly or in combination of two or more. Among these dyes, leuco dyes having the fluoran structure are preferable due to the excellent color forming property. Examples of the leuco dye having the fluoran structure include 3-isoamylethylamino-6-methyl-7-anilinofluoran, 3-[N-(4-methylphenyl)-N-ethyl]amino-6-methyl-7-anilinofluoran, 3-diamyl-amino-6-methyl-7-anilinofluoran, 3-dibutylamino-6-methyl-7-anilinofluoran, 3-diethylamino-6-methyl-7-anilinofluoran and 3-cyclohexyl-methylamino-6-methyl-7-anilinofluoran. In the present invention, the amount of the color forming substance in the heat sensitive color forming layer can be suitably selected in accordance with the properties of the object recording material.

In the heat sensitive recording material of the present invention, the heat sensitive color forming layer may further comprise a sensitizer and/or an image stabilizer. The sensitizer is not particularly limited. It is preferable that the sensitizer has a melting point of 90 to 140° C. Examples of the sensitizer include fatty acid amides such as stearic acid amide, ethers such as 1,2-bisphenoxyethane, 1,2-bis(m-tolyloxy)ethane and 2-benzyloxynaphthalene, esters such as di(4-methylbenzyl) oxalate, sulfonamides such as N-phenylsulfonamide, sulfonic acid esters such as toluenesulfonic acid naphthyl ester, aromatic hydrocarbon compounds such as m-terphenyl and p-benzylbiphenyl, various types of wax, condensation products of aromatic carboxylic acids and amines, higher linear chain glycols, higher ketones; diphenylsulfone, derivatives of bisphenol S, derivatives of bisphenol A, p-hydroxybenzoic acid esters and phthalic acid diesters. The sensitizer may be used singly or in combination of two or more. It is preferable that the content of the sensitizer is 40 to 400 parts by mass per 100 parts by mass of the color developer.

The image stabilizing substance comprised in the heat sensitive color forming layer in the heat sensitive recording material of the present invention is not particularly limited. Examples of the image stabilizing substance include 4-benzyloxy-4'-(2-methylglycidyloxy)diphenylsulfone, 1,1,3-tris (2-methyl-4-hydroxy-5-cyclohexylphenyl)butane, 1,1,3-tris (2-methyl-4-hydroxy-5-tert-butylphenyl)butane and substances having the urethane structure. The image stabilizing substance may be used singly or in combination of two or more.

In the heat sensitive recording material of the present invention, other color developers may used in combination with the combination of 4-allyloxy-4'-hydroxydiphenylsulfone with 3-allyl-4-allyloxy-4'-hydroxydiphenylsulfone, 4-allyloxy-3'-allyl-4'-hydroxydiphenylsulfone or a mixture of these two compounds. The other color developer used in combination is not particularly limited. Examples of the other color developer used in combination include derivatives of phenylsulfone and benzenesulfonic acid such as 4,4'-dihydroxydiphenylsulfone, 2,4'-dihydroxydiphenylsulfone, 3,3'-diallyl-4,4'-dihydroxydiphenylsulfone and 4-hydroxybenzenesulfonic acid phenyl ester. By using the other color developer in combination, the color forming substance occasionally exhibits the color formation to a greater degree. It is preferable that the content of the entire color developer is 100 to 500 parts by mass per 100 parts by mass of the color forming substance.

In the heat sensitive recording material of the present invention, the heat sensitive color forming layer may comprise fillers, where necessary. Examples of the filler include inorganic fillers and organic fillers. The heat sensitive color forming layer may further comprise other additives, where necessary. Examples of the other additive include lubricants, ultraviolet light absorbents, agents providing water resistance, dispersants, defoaming agents, antioxidants and fluorescent dyes.

The process for producing the heat sensitive recording material of the present invention is not particularly limited. The heat sensitive recording material can be produced, for example, by preparing a coating fluid for the heat sensitive color forming layer by dispersing the color forming substance, the color developer, the sensitizer, the image stabilizing substance and other components added where necessary in a medium such as an aqueous medium in combination with a suitable binder, followed by applying the coating fluid to a support, and drying the formed coating layer. The dispersion comprising the color forming substance, the color developer and the sensitizer may be prepared by preparing a dispersion comprising the color forming substance, a dispersion comprising the color developer and a dispersion comprising the sensitizer separately, followed by mixing the prepared dispersions. It is preferable that a sand mill, a ball mill or the like is used for the preparation of the dispersion since it is preferable that the color forming substance, the color developer and the sensitizer are dispersed in each dispersion as fine particles.

The binder used in the heat sensitive recording material of the present invention is not particularly limited. Examples of the binder include cellulose derivatives such as hydroxyethylcellulose and carboxymethylcellulose, polyvinyl alcohols such as polyvinyl alcohol and modified polyvinyl alcohol, gelatin, casein, starch, polyacrylic acid, polyacrylic acid esters, polyvinyl acetate, polyacrylamide, styrene-maleic acid copolymers, styrene-butadiene copolymers, polyamide resins, petroleum resins and terpene resins. The binder may be used singly or in combination of two or more.

In the heat sensitive recording material of the present invention, an undercoat layer comprising inorganic fillers and organic fillers may be formed, where necessary. Where necessary, an overcoat layer may be formed on the heat sensitive color forming layer. To form the overcoat layer, a cellulose derivative, a water-soluble resin such as polyvinyl alcohol, a water-soluble emulsion resin such as a styrene-butadiene copolymer or a water-insoluble resin may be used, and fillers, monomers and oligomers such as isocyanates and unsaturated compounds and crosslinking agents may be added to the resin.

The heat sensitive recording material of the present invention may be a multi-color heat sensitive recording material comprising a plurality of color forming layers comprising color forming substances exhibiting different color tones.

EXAMPLES

The present invention will be described more specifically with reference to examples in the following. However, the present invention is not limited to the examples.

In Examples and Comparative Examples, the fog on the background, the color forming property, the resistance to heat and moisture, and the heat resistance were evaluated in accordance with the following methods.

(1) Fog on the Background

A dispersion of a color forming substance was prepared by finely pulverizing and dispersing 40 parts by mass of 3-dibutylamino-6-methyl-7-anilinofluoran, 80 parts by mass of a 10% by mass aqueous solution of polyvinyl alcohol and 40 parts by mass of water for 4 hours using a sand mill. A dispersion of a color developer was prepared by finely pulverizing and dispersing 28 parts by mass of 4-allyloxy-4'-hydroxydiphenylsulfone containing 3-allyl-4-allyloxy-4'-hydroxydiphenylsulfone, 4-allyloxy-3'-allyl-4'-hydroxydiphenylsulfone or a mixture of these two compounds, 120 parts by mass of a 10% by mass aqueous solution of polyvinyl alcohol and 52 parts by mass of water for 3 hours using a sand mill. A binder solution was prepared by mixing 60 parts by mass of a 10% by mass aqueous solution of polyvinyl alcohol and 40 parts by mass of water. A fluid for preparation of coating was prepared by mixing 30 parts by mass of the dispersion of the color developer, 30 parts by mass of the binder solution and 8 parts by mass of a 10% by mass aqueous solution of polyvinyl alcohol under stirring. Then, a test fluid for the color forming layer was prepared by mixing 11.3 parts by mass of the dispersion of the color forming substance and 100 parts by mass of the fluid for preparation of coating. The prepared test fluid was placed into a test tube, which was then dipped into a water bath at 50° C. for 2 hours. The coloration of the test fluid was evaluated as the scale value N in accordance with the brightness scale (supervised by the committer of color charts of the Japanese Industrial Standard; published by NIPPON KIKAKU KYOKAI; prepared by NIPPON SHIKISAI KENKYUSHO). When the test fluid had the scale value of N 9.5, the test fluid had no color, and fog was not formed on the background of the heat sensitive recording material. The smaller the scale value N, the denser the color of the test fluid and the greater the tendency to form fog on the background.

(2) Color Forming Property

Using a heat sensitive printing apparatus (manufactured by OKURA DENKI Co., Ltd.), the color formation was conducted under a printing energy increasing by an increment of 0.07 mJ/dot at a pulse width of 3 ms. The color density of the obtained image was measured using a MACBETH densitometer. The smaller the value, the thinner the image. The greater the value, the denser the image.

(3) Heat Resistance

An image formed by using the heat sensitive printing apparatus used above under a printing voltage of 20 V at a pulse width of 3 ms and the blank portions were left standing at 60° C. or 100° C. for 24 hours. The color density was measured at the image portion and at the blank portion before and after the test using a MACBETH densitometer. The smaller the value, the thinner and whiter the image. The greater the value, the denser and the more blackish the image.

(4) Resistance to Heat and Moisture

An image formed by using the heat sensitive printing apparatus used above under a printing voltage of 20 V at a pulse width of 3 ms and the blank portions were left standing at 60° C. and 80% RH for 24 hours. The color density was measured at the image portion and the blank portions before and after the test using a MACBETH densitometer. The smaller the value, the thinner and whiter the image. The greater the value, the denser and the more blackish the image.

Example 1

Into a reactor equipped with a stirrer and a condenser, 1,000 parts by mass of purified water, 250 parts by mass of 4,4'-dihydroxydiphenylsulfone and 44 parts by mass of sodium hydroxide were placed, and 84.2 parts by mass of allyl chloride was added dropwise to the obtained mixture at 55° C. over 4 hours. After the addition was completed, the reaction mixture was stirred at 55 to 65° C. until no refluxing was found, and then the reaction was allowed to continue at 55 to 65° C. for 3 hours. When the reaction was completed, 40 parts by mass of sodium hydroxide was added. The mixture was heated at 80° C., and byproducts were removed by filtration.

To the obtained filtrate at 80° C., hydrochloric acid was added to adjust pH at 9, and the formed product was separated by filtration. Into a vessel equipped with a stirrer and a condenser, the product obtained above, 420 parts by mass of purified water and 140 parts by mass of 2-propanol were placed, and the obtained mixture was heated under the refluxing condition for 1 hour. The mixture was cooled to the room temperature, and the formed purified product was separated by filtration and dried. The amount of the obtained purified product was 112 parts by mass and contained 0.7 parts by mass of 3-allyl-4-allyloxy-4'-hydroxydiphenylsulfone and 0.3 parts by mass of 4-allyloxy-3'-allyl-4'-hydroxydiphenylsulfone per 100 parts by mass of 4-allyloxy-4'-hydroxydiphenylsulfone.

In the test of fog on the background on the obtained purified product, the brightness was found to be N 9.

A dispersion of a color forming substance (Fluid A) was prepared by finely pulverizing and dispersing 40 parts by mass of 3-dibutylamino-6-methyl-7-anilinofluoran, 80 parts by mass of a 10% by mass aqueous solution of polyvinyl alcohol and 40 parts by mass of water for 4 hours using a sand mill. A dispersion of a color developer (Fluid B) was prepared by finely pulverizing and dispersing 28 parts by mass of the purified product obtained above, 120 parts by mass of a 10% by mass aqueous solution of polyvinyl alcohol and 52 parts by mass of water for 3 hours using a sand mill. A dispersion of a sensitizing substance (Fluid C) was prepared by finely pulverizing and dispersing 28 parts by mass of 1,2-bis(phenoxymethyl)benzene, 120 parts by mass of a 10% by mass aqueous solution of polyvinyl alcohol and 52 parts by mass of water for 4 hours using a sand mill. Fluid D was prepared by mixing 60 parts by mass of Fluid B, 60 parts by mass of Fluid C, 16 parts by mass of a 10% by mass aqueous solution of polyvinyl alcohol and 12.2 parts by mass of kaolin using a disper under stirring. Then, a coating fluid for the color forming layer was prepared by mixing 11.3 parts by mass of Fluid A and 100 parts by mass of Fluid D. A high quality paper having a unit weight of 65 g/m$^2$ was coated with the coating fluid prepared above in an amount of about 6 g/m$^2$ after being dried. The coating layer was dried under a stream of the air and treated by calendering. The heat sensitive recording material thus prepared was evaluated.

The heat sensitive recording material had a color density of 0.23 at a printing energy of 0.28 mJ/dot and 0.51 at a printing energy of 0.35 mJ/dot in the test of color formation. The color density of the image portion was 1.02 before the test, 0.98 after the test of heat resistance at 60° C., 0.93 after the test of heat resistance at 100° C., and 0.56 after the test of resistance to heat and moisture. The color density of the blank portion was 0.08 before the test, 0.08 after the test of heat resistance at 60° C., 0.50 after the test of heat resistance at 100° C., and 0.08 after the test of resistance to heat and moisture.

Example 2

In accordance with the same procedures as those conducted in Example 1, 1,000 parts by mass of water, 250 parts by mass of 4,4'-dihydroxydiphenylsulfone and 44 parts by mass of sodium hydroxide were placed into a reactor, and 84.2 parts by mass of allyl chloride was added dropwise to the resultant mixture at 50 to 55 over 2 hours. After the addition was completed, the reaction mixture was stirred at 55 to 65° C. until no refluxing was found, and then the reaction was allowed to continue at 55 to 65° C. for 6 hours.

After the reaction was completed, 100 parts by mass of a purified product was obtained in accordance with the same procedures as those conducted in Example 1. The obtained purified product contained 2.0 parts by mass of 3-allyl-4-allyloxy-4'-hydroxydiphenylsulfone and 1.0 part by mass of 4-allyloxy-3'-allyl-4'-hydroxydiphenylsulfone per 100 parts by mass of 4-allyloxy-4'-hydroxydiphenylsulfone.

In the test of fog on the background on the obtained purified product, the brightness was found to be N 8.5.

A heat sensitive recording material was prepared and evaluated in accordance with the same procedures as those conducted in Example 1 except that a dispersion of the color developer (Fluid B) was prepared using the purified product obtained above in place of the purified product obtained in Example 1. The heat sensitive recording material had a color density of 0.29 at a printing energy of 0.28 mJ/dot and 0.57 at a printing energy of 0.35 mJ/dot in the test of color formation. The color density of the image portion was 0.99 before the test, 0.95 after the test of heat resistance at 60° C., 0.91 after the test of heat resistance at 100° C., and 0.64 after the test of resistance to heat and moisture. The color density of the blank portion was 0.08 before the test, 0.08 after the test of heat resistance at 60° C., 0.52 after the test of heat resistance at 100° C., and 0.08 after the test of resistance to heat and moisture.

Comparative Example 1

Into a reactor equipped with a stirrer and a condenser, 1,000 parts by mass of purified water, 250 parts by mass of 4,4'-dihydroxydiphenylsulfone and 44 parts by mass of sodium hydroxide were placed, and 84.2 parts by mass of allyl chloride was added dropwise to the obtained mixture at 55° C. over 4 hours. After the addition was completed, the reaction mixture was stirred at 55 to 65° C. until no refluxing was found, and then the reaction was allowed to continue at 55 to 65° C. for 3 hours. When the reaction was completed, 40 parts by mass of sodium hydroxide was added. The mixture was heated at 80° C., and byproducts were removed by filtration.

To the obtained filtrate at 80° C., hydrochloric acid was added to adjust pH at 9, and the formed product was separated by filtration. Into a vessel equipped with a stirrer and a condenser, the above product and 400 parts by mass of ethyl acetate were placed, and the obtained mixture was heated 70° C. Insoluble components were removed by filtration. The filtrate at 70° C. was slowly cooled, and the formed purified product was separated by filtration and dried.

The obtained purified product contained 0.2 parts by mass of 3-allyl-4-allyloxy-4'-hydroxydiphenylsulfone per 100 parts by mass of 4-allyloxy-4'-hydroxydiphenylsulfone and no measurable amount of 4-allyloxy-3'-allyl-4'-hydroxydiphenylsulfone.

In the test of fog on the background on the obtained purified product, the brightness was found to be N 9.5.

A heat sensitive recording material was prepared and evaluated in accordance with the same procedures as those conducted in Example 1 except that a dispersion of the color developer (Fluid B) was prepared using the purified product obtained above in place of the purified product obtained in Example 1. The heat sensitive recording material had a color density of 0.22 at a printing energy of 0.28 mJ/dot and 0.46 at a printing energy of 0.35 mJ/dot in the test of color formation. The color density of the image portion was 0.98 before the test, 0.91 after the test of heat resistance at 60° C., 0.81 after the test of heat resistance at 100° C., and 0.48 after the test of resistance to heat and moisture. The color density of the blank portion was 0.08 before the test, 0.08 after the test of heat resistance at 60° C., 0.45 after the test of heat resistance at 100° C., and 0.07 after the test of resistance to heat and moisture.

Comparative Example 2

Into a reactor equipped with a stirrer and a condenser, 1,000 parts by mass of purified water, 250 parts by mass of 4,4'-dihydroxydiphenylsulfone and 48 parts by mass of sodium hydroxide were placed, and 91.8 parts by mass of allyl chloride was added dropwise to the obtained mixture at 65° C. over 2 hours. After the addition was completed, the reaction mixture was stirred at 65° C. until no refluxing was found, and then the reaction was allowed to continue at 65 to 75° C. for 6 hours. When the reaction was completed, 40 parts by mass of sodium hydroxide was added. The mixture was heated at 80° C., and byproducts were removed by filtration.

To the obtained filtrate at 80° C., hydrochloric acid was added to adjust pH at 9, and the formed product was separated by filtration. Into a vessel equipped with a stirrer and a condenser, the above product, 420 parts by mass of purified water and 140 parts by mass of 2-propanol were placed. After the resultant mixture was heated under the refluxing condition for 1 hour, the reaction mixture was cooled to the room temperature. The formed purified product was separated by filtration and dried. The amount of the obtained purified product was 105 parts by mass, and the obtained purified product contained 4.0 parts by mass of 3-allyl-4-allyloxy-4'-hydroxydiphenylsulfone and 2.0 parts by mass of 4-allyloxy-3'-allyl-4'-hydroxydiphenylsulfone per 100 parts by mass of 4-allyloxy-4'-hydroxydiphenylsulfone.

In the test of fog on the background on the obtained purified product, the brightness was found to be N 6.5.

A heat sensitive recording material was prepared and evaluated in accordance with the same procedures as those conducted in Example 1 except that a dispersion of the color developer (Fluid B) was prepared using the purified product obtained above in place of the purified product obtained in Example 1. The heat sensitive recording material had a color density of 0.32 at a printing energy of 0.28 mJ/dot and 0.57 at a printing energy of 0.35 mJ/dot in the test of color formation. The color density of the image portion was 0.99 before the test, 0.96 after the test of heat resistance at 60° C., 0.90 after the test of heat resistance at 100° C., and 0.68 after the test of resistance to heat and moisture. The color density of the blank portion was 0.10 before the test, 0.10 after the test of heat resistance at 60° C., 0.50 after the test of heat resistance at 100° C., and 0.10 after the test of resistance to heat and moisture.

Comparative Example 3

The test of fog on the background was conducted using 4,4'-dihydroxydiphenylsulfone, and the brightness was found to be N 8.

Comparative Example 4

The test of fog on the background was conducted using 4-isopropoxy-4'-hydroxydiphenylsulfone, and the brightness was found to be N 8.5.

The compositions of the color developers and the results of evaluation of the fog on the background in Examples 1 and 2 and Comparative Examples 1 to 4 are shown in Table 1. The results of the evaluation of the color forming property in Example 1 and 2 and Comparative Examples 1 and 2 are shown in Table 2. The results of the evaluation of the storage property of the image portion are shown in Table 3. The results of the evaluation of the storage property of the blank portion are shown in Table 4.

TABLE 1

| | Developer (Part by mass) | | | | | |
|---|---|---|---|---|---|---|
| | 4-allyloxy-4'-hydroxy-diphenyl-sulfone | 3-allyl-4-allyloxy-4'-hydroxy-diphenyl-sulfone | 4-allyloxy-3'-allyl-4'-hydroxy-diphenyl sulfone | 4,4'-di-hydroxy-diphenyl-sulfone | 4-isopropoxy-4'-hydroxy-diphenyl-sulfone | Fog on background (Brightness) |
| Example 1 | 100 | 0.7 | 0.3 | — | — | N 9 |
| Example 2 | 100 | 2.0 | 1.0 | — | — | N 8.5 |
| Comparative Example 1 | 100 | 0.2 | — | — | — | N 9.5 |
| Comparative Example 2 | 100 | 4.0 | 2.0 | — | — | N 6.5 |
| Comparative Example 3 | — | — | — | 100 | — | N 8 |
| Comparative Example 4 | — | — | — | — | 100 | N 8.5 |

TABLE 2

| Printing Energy | Color density | | | | |
|---|---|---|---|---|---|
| (mJ/dot) | 0.14 | 0.21 | 0.28 | 0.35 | 0.42 |
| Example 1 | 0.08 | 0.11 | 0.23 | 0.51 | 0.74 |
| Example 2 | 0.08 | 0.12 | 0.29 | 0.57 | 0.79 |
| Comparative Example 1 | 0.08 | 0.10 | 0.22 | 0.46 | 0.71 |
| Comparative Example 2 | 0.10 | 0.14 | 0.32 | 0.57 | 0.77 |

TABLE 3

| | Color density at image portion | | | |
|---|---|---|---|---|
| | before test | heat resistance at 60° C. | heat resistance at 100° C. | resistance to heat and moisture |
| Example 1 | 1.02 | 0.98 | 0.93 | 0.56 |
| Example 2 | 0.99 | 0.95 | 0.91 | 0.64 |
| Comparative Example 1 | 0.98 | 0.91 | 0.81 | 0.48 |
| Comparative Example 2 | 0.99 | 0.96 | 0.90 | 0.68 |

TABLE 4

| | Color density at blank portion | | | |
|---|---|---|---|---|
| | before test | heat resistance at 60° C. | heat resistance at 100° C. | resistance to heat and moisture |
| Example 1 | 0.08 | 0.08 | 0.50 | 0.08 |
| Example 2 | 0.08 | 0.08 | 0.52 | 0.08 |
| Comparative Example 1 | 0.08 | 0.08 | 0.45 | 0.07 |
| Comparative Example 2 | 0.10 | 0.10 | 0.50 | 0.10 |

The color developer of Examples 1 containing 1.0 part by mass of a mixture of 3-allyl-4-allyloxy-4'-hydroxydiphenylsulfone and 4-allyloxy-3'-allyl-4'-hydroxydiphenylsulfone per 100 parts by mass of 4-allyloxy-4'-hydroxydiphenylsulfone and the color developer of Example 2 containing 3.0 parts by mass of a mixture of 3-allyl-4-allyloxy-4'-hydroxydiphenylsulfone and 4-allyloxy-3'-allyl-4'-hydroxydiphenylsulfone per 100 parts by mass of 4-allyloxy-4'-hydroxydiphenylsulfone suppressed the formation of fog on the background to the degree of or greater than that of 4-isopropoxy-4'-hydroxydiphenylsulfone.

The heat sensitive recording papers of Examples 1 and 2 prepared by using the color developer containing 1.0 parts by mass and 3.0 parts by mass, respectively, of a mixture of 3-allyl-4-allyloxy-4'-hydroxydiphenylsulfone and 4-allyloxy-3'-allyl-4'-hydroxydiphenylsulfone per 100 parts by mass of 4-allyloxy-4'-hydroxydiphenylsulfone exhibited excellent color forming property, storage property of the image portion and storage property of the blank portion.

The color developer of Comparative Example 1 containing 0.2 parts by mass of 3-allyl-4-allyloxy-4'-hydroxydiphenylsulfone per 100 parts by mass of 4-allyloxy-4'-hydroxydiphenylsulfone showed a smaller color density in the test of color formation to show an inferior color forming property, and the storage property of the image portion was inferior in both of the test of the heat resistance and the test of the resistance to heat and moisture although fog on the background was suppressed.

The color developer of Comparative Example 1 containing 6.0 parts by mass of a mixture of 3-allyl-4-allyloxy-4'-hydroxydiphenylsulfone and 4-allyloxy-3'-allyl-4'-hydroxydiphenylsulfone per 100 parts by mass of 4-allyloxy-4'-hydroxydiphenylsulfone showed a greater tendency to form fog on the background than that of 4,4'-dihydroxydiphenylsulfone although the color forming property and the storage property of the image portion were excellent.

INDUSTRIAL APPLICABILITY

The heat sensitive recording material of the present invention comprising the color developer for heat sensitive recording of the present invention in the heat sensitive color forming layer suppresses fog on the background. The heat sensitive recording material exhibits the excellent color forming property and can be used under a small electric current of portable terminals and also for high speed printing. The heat sensitive recording material of the present invention exhibits the excellent storage property of the image portion and can be used under severe conditions of the environment after the image portion is formed by printing.

The invention claimed is:

1. A color developer for heat sensitive recording which comprises 0.5 to 5 parts by mass of at least one compound selected from the group consisting of 3-allyl-4-allyloxy-4'-hydroxydiphenylsulfone and 4-allyloxy-3'-allyl-4'-hydroxydiphenylsulfone per 100 parts by mass of 4-allyloxy-4'-hydroxy-diphenylsulfone.

2. A process for producing a color developer for heat sensitive recording described in claim 1 which comprises reacting 1.03 to 1.18 moles of an allyl halide with 1 mole of 4,4'-dihydroxyldiphenylsulfone in the presence of an alkali to produce a reaction product and recrystallizing the reaction product in a mixed solvent of water and an alcohol.

3. A heat sensitive recording material comprising a support and a heat sensitive color forming layer, wherein said heat sensitive color forming layer comprises a color developer for heat sensitive recording which comprises 0.5 to 5 parts by mass of at least one compound selected from the group consisting of 3-allyl-4-allyloxy-4'-hydroxydiphenylsulfone and 4-allyloxy-3'-allyl-4'-hydroxydiphenylsulfone per 100 parts by mass of 4-allyloxy-4'-hydroxydiphenylsulfone.

4. The heat sensitive recording material according to claim 3, wherein the heat sensitive color forming layer further comprises a colorless or slightly colored leuco dye as a color forming substance.

5. The heat sensitive recording material according to claim 4, wherein the leuco dye is a dye having a fluoran structure.

6. The heat sensitive recording material according to claim 5, wherein the heat sensitive color forming layer further comprises a sensitizer.

7. The heat sensitive recording material according to claim 6, wherein the heat sensitive color forming layer further comprises an image stabilizing substance.

8. The heat sensitive recording material according to claim 5, wherein the heat sensitive color forming layer further comprises an image stabilizing substance.

9. The heat sensitive recording material according to claim 4, wherein the heat sensitive color forming layer further comprises a sensitizer.

10. The heat sensitive recording material according to claim 9, wherein the heat sensitive color forming layer further comprises an image stabilizing substance.

11. The heat sensitive recording material according to claim 4, wherein the heat sensitive color forming layer further comprises an image stabilizing substance.

12. The heat sensitive recording material according to claim 3, wherein the heat sensitive color forming layer further comprises a sensitizer.

13. The heat sensitive recording material according to claim 12, wherein the heat sensitive color forming layer further comprises an image stabilizing substance.

14. The heat sensitive recording material according to claim 3, wherein the heat sensitive color forming layer further comprises an image stabilizing substance.

* * * * *